United States Patent [19]

Ceintrey et al.

[11] Patent Number: 4,584,256

[45] Date of Patent: Apr. 22, 1986

[54] DIAZOTYPE MATERIALS WHICH CAN BE DEVELOPED BY HEAT AND CONTAIN AN ACTIVATOR PRECURSOR HAVING 2-CARBOXY CARBOXAMIDE GROUP RELEASING A STRONG BASE DURING HEATING

[75] Inventors: Claude Ceintrey, Neuville-les-Dieppe; Michel Crochemore, Chaponost, both of France

[73] Assignee: Rhone-Poulenc Systemes, Creteil, France

[21] Appl. No.: 674,347

[22] PCT Filed: Nov. 19, 1981

[86] PCT No.: PCT/FR81/00151

§ 371 Date: Jul. 30, 1982

§ 102(e) Date: Jul. 30, 1982

[87] PCT Pub. No.: WO82/01944

PCT Pub. Date: Jun. 10, 1982

Related U.S. Application Data

[63] Continuation of Ser. No. 403,613, Jul. 30, 1982, abandoned.

[30] Foreign Application Priority Data

Dec. 2, 1980 [FR] France ..... 80 25958

[51] Int. Cl.[4] ..... G03C 1/60

[52] U.S. Cl. ..... 430/159; 430/151; 430/158; 430/161; 430/162; 430/178; 430/179

[58] Field of Search ..... 430/151, 178, 179, 158, 430/159, 161, 162

[56] References Cited

U.S. PATENT DOCUMENTS

| | | | |
|---|---|---|---|
| 3,367,776 | 2/1968 | Bialczak | 430/151 |
| 3,389,996 | 6/1968 | Welch | 430/178 |
| 3,420,666 | 1/1969 | Welch | 430/151 |
| 3,453,112 | 7/1969 | Schaeffer | 430/151 |
| 3,625,693 | 12/1971 | Iwaoka | 430/151 |
| 3,642,483 | 2/1972 | Kubo et al. | 430/179 |
| 3,650,750 | 3/1972 | Iwata et al. | 430/151 |
| 3,754,916 | 8/1973 | Winslow et al. | 430/151 |
| 4,088,496 | 5/1978 | Merkel | 430/179 |

FOREIGN PATENT DOCUMENTS

| | | | |
|---|---|---|---|
| 1452286 | 9/1966 | France . | |
| 1499319 | 10/1967 | France . | |
| 2056231 | 5/1971 | France . | |
| 2360909 | 3/1978 | France . | |
| 2375620 | 7/1978 | France . | |
| 998949 | 7/1965 | United Kingdom . | |
| 1041022 | 9/1966 | United Kingdom | 430/151 |

OTHER PUBLICATIONS

Kosar, J., Photo. Sci. & Eng., vol. 5, No. 4, 7/8/1961, pp. 239–243.

*Primary Examiner*—Charles L. Bowers, Jr.
*Attorney, Agent, or Firm*—Sherman and Shalloway

[57] ABSTRACT

The invention relates to new diazotype materials of which the sensitive layer contains, as a base generator, a compound comprising a basic part and an acid part, the acid part being a 2-carboxycarboxamide group and the basic part consisting of an alkali metal cation or alkaline earth metal cation or a tetraalkylammonium cation.

These diazotype materials develop rapidly and possess an excellent resistance to ageing.

14 Claims, No Drawings

DIAZOTYPE MATERIALS WHICH CAN BE DEVELOPED BY HEAT AND CONTAIN AN ACTIVATOR PRECURSOR HAVING 2-CARBOXY CARBOXAMIDE GROUP RELEASING A STRONG BASE DURING HEATING

This application is a continuation of application Ser. No. 403,613, filed July 30, 1982, abandoned.

The present invention relates, by way of new industrial products, to diazotype products which can be developed by heat and of which the sensitive layer contains an activator precursor for the coupling reaction. The present invention also relates to a thermal diazo copying process characterised by the use of the diazotype products of the invention.

Diazotype products are already known which can be developed by heat and of which the sensitive layer, which is generally a two-component layer and which thus contains a diazonium salt and a coupler, contains an activator precursor for the coupling reaction, the activator precursor also being commonly referred to as a base generator. In fact, the activator precursor generally releases a basic compound, such as ammonia or a nitrogen-containing organic base, under the action of heat.

Thus, British Pat. No. 998,949 (KODAK, U.S. Priority of 27.06.1960) describes diazotype materials of which the sensitive layer contains a colloidal binder, a diazonium salt, a coupler and at least one thermolabile salt of an organic carboxylic acid and an organic base. After exposure, developing is ensured by heating to a temperature between 60° and 130° C. during which time the salt is decomposed into carbon dioxide and a basic compound, the latter activating the coupling reaction. As a general rule, the thermolabile salt consists of a trihalogenoacetate of a nitrogen-containing organic base, such as piperidinium trichloroacetate, which releases carbon dioxide, a halogenoform (chloroform) and a nitrogen-containing organic base (piperidine) on heating. Volatile compounds are therefore evolved from these activator precursors, and these volatile compounds can form undesirable bubbles in the developed diazotype material, which is of course a disadvantage. It is also known that the halogenoform released combines with the diazotype printing products to give a yellow background on developing, which intensifies during storage.

U.S. Pat. No. 3,625,693 of RICOH (Japanese Priority of 9.11.1966) describes a diazotype material of which the sensitive layer contains an aryldiazonium salt carrying a free carboxyl group in the ortho-position to the diazonium group, a coupler, and a base generator which, under the action of heat, releases a base which initiates and completes the coupling reaction. The activator precursor, also referred to as a base generator, can be urea, thiourea or their derivatives, guanidine or its derivatives, amides, or alternatively salts of trichloroacetic acid and a basic compound such as ammonia, an amine a guanidine or an inorganic base.

According to U.S. Pat. No. 3,625,693, the process makes it possible to obtain diazotype materials which are stable on storage, by virtue of the particular choice of the diazonium compound. However, this is a disadvantage because it considerably limits the possible choice of the diazonium compound.

This U.S. Pat. No. 3,625,693 indeed emphasises the difficulties which are encountered in practice if it is desired to prepare a two-component diazotype material of which the sensitive layer contains a base generator in addition to the diazonium salt and the coupler. It is in fact stipulated that these diazotype materials generally have a low storage stability, which simultaneously results in an increase in the background and a weakening of the coloured images.

French Pat. No. 2,056,231 of RICOH (French Application No. 70/20,228) describes diazotype materials which make it possible to obtain an intense black azo image by virtue of the particular choice of the coupler (a phenol carrying carboxyl groups) and of specific mixtures of diazonium salts carrying carboxyl groups. Furthermore, it is indicated on page 8 that the storage properties of the diazotype material are only obtained if the photosensitive layer does not contain alkali generator.

French Pat. No. 2,360,909 (National Registration No. 77/24,157) describes activator precursors comprising an acid part and a basic part, the acid part being an $\alpha$-sulphonylacetate group. These precursors, which, during heating, release carbon dioxide as a result of a decarboxylation reaction, and also an organic base, can be used in diazotype materials which can be developed by heat, but they exhibit the disadvantage of releasing carbon dioxide, which can cause the formation of bubbles or holes on the material developed by heat.

Finally, French Pat. No. 2,375,620 of KODAK (National Registration No. 77/38,732) describes two-component diazotype materials containing an activator precursor for the coupling reaction, which consists of a basic part and an acid part, the acid part being a 2-carboxycarboxamide group. The basic part consists of a protonated nitrogen-containing basic group such as amine and isothiouronium groups. On heating, the activator precursors, such as the salt of N,N'-ethylene-bisphthalamic acid and 1,3-bis-(2-aminothiazolin-2-yl)-propane, release the corresponding basic compound, while the carboxyl group disappears as a result of a thermal cyclisation. Thus, it is observed that the organic base is released by heating, without the evolution of a volatile product, and this is, of course, a distinct advantage. However, these diazotype materials are not without any disadvantages. The developing speed on heating, even at elevated temperature, is in fact slow. Furthermore, it has been observed that the exposed and aged materials subsequently keep rather poorly, while a background colouration is seen to appear and develop, which is without any doubt associated with the presence of an excess of basic compound remaining on the base material after the developing of the image.

Thus, there was the problem of perfecting new diazotype materials which can be developed by heat, which possess a combination of properties suitable for ensuring a good commercial development thereof, which have, in particular, a good storage stability, a good sensitivity to the exposure source, a sufficient developing speed at a temperature which is not too high without release of volatile products, and which at the same time ensure a good intensity of the colour of the image, a good definition of the image (no appearance of holes or bubbles) and a good resistance to ageing after exposure and developing.

The present invention achieves this object precisely. New diazotype materials which can be developed by heat have been found, of which the sensitive layer contains a base generator as an activator precursor for the coupling reaction generating a coloured trace from a diazonium salt and a coupler, the base generator comprising a basic part and an acid part, and the acid part being a 2-carboxycarboxamide group, the diazotype materials being characterized in that the basic part of the base generator consists of an alkali metal cation or alkaline earth metal cation or a quaternary tetraalkylammonium cation; it is these new diazotype materials which constitute the subject of the present invention.

It has been found that such diazotype materials permit rapid developing. Furthermore, it has been demonstrated that, after exposure and developing, the diazotype materials according to the invention have a much better resistance to ageing than the diazotype materials comprising, as activator precursors, a compound comprising a basic part and an acid part, the acid part being a 2-carboxycarboxamide group and the basic part consisting of a protonated nitrogen-containing basic group. A result of this kind is unexpected because the activator precursor according to the invention releases a strong base which therefore has a high pKa, which is not volatile during the thermal developing treatment, and the presence of which could only be considered as jeopardising a good resistance to ageing. Furthermore, the existence of this excellent resistance to ageing seemed unforeseeable in the light of the prior art and in particular of French Pat. No. 2,056,231.

More precisely, the subject of the present invention consists of new diazotype materials which can be developed by heat and of which the sensitive layer contains, as an activator precursor for the coupling reaction, a base generator containing a 2-carboxycarboxamide group and represented by the general formula (I):

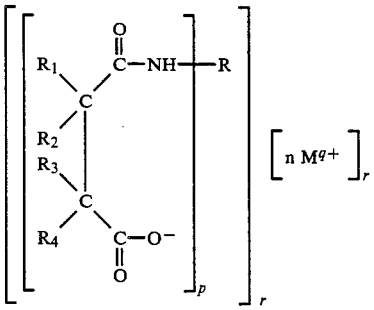

in which the various symbols represent the following:

$R_1$, $R_2$, $R_3$ and $R_4$: a hydrogen atom, a halogen atom or an alkyl or halogenoalkyl, alkoxy, alkoxycarbonyl, hydroxyl, carbamoyl or carboxamide group, it being possible for the groups $R_1$ and/or $R_2$ to form, with the groups $R_3$ and/or $R_4$, a valence bond and/or a divalent group forming, with the two carbon atoms to which the groups $R_1$ (or $R_2$) and $R_3$(or $R_4$) are attached, a group (L) which can optionally contain another 2-carboxycarboxamide group, and the group (L) being cyclic or polycyclic or alternatively consisting of a combination of several cyclic groups joined to one another by a valence bond, a hetero-atom or a methylene or carboxyl group, r: an integer equal to 1 or 2, p: an integer equal to 1 or 2 and representing the valence of the symbol R, R: a valence bond or one of the following radicals:

(a) a monovalent radical consisting of a hydrogen atom, a group —$CONHR_5$ or —$CSNHR_5$ ($R_5$ being a hydrogen atom or an alkyl radical), a saturated or unsaturated, aliphatic or cycloaliphatic hydrocarbon radical or an aromatic radical, these various radicals being optionally substituted by alkyl groups which are themselves optionally halogenated, by halogen atoms, by carboxyl or nitro groups or by urea, thiourea or hydroxyl groups, (b) a divalent alkylene, cycloalkylene or phenylene radical or a combination of alkylene or phenylene groups joined to one another by a hetero-atom or a group $$-\underset{\underset{R_5}{|}}{N}-,$$

$R_5$ representing a hydrogen atom or an alkyl group,

M: an alkali metal cation or alkaline earth metal cation of valence q or a quaternary tetraalkylammonium cation, n: an integer equal to 1 or 2 and such that the overall ionic charge on the base generator is zero.

It is thus observed that the base generator can be a phthalamic acid derivative, a maleamic acid derivative, a succinamic acid derivative or a polyhydrophthalic acid derivative. Obviously, these various base generators, which can be mixed with one another, can also contain any substituent which does not have an unfavourable effect on the sensitometric characteristics or the other properties of the diazotype material which can be developed by heat. These various substituents can be carried by the groups (L) or (R).

Preferably, the present invention consists of new diazotype materials which can be developed by heat and of which the sensitive layer contains, as an activator precursor for the coupling reaction, a compound containing a '-carboxycarboxamide group and of the formula (I) in which the various symbols represent the following:

$R_1$, $R_2$, $R_3$ and $R_4$: a hydrogen atom, a chlorine atom or an alkyl or alkoxy group having from 1to 4 carbon atoms, two of the groups $R_1$, $R_2$, $R_3$ and $R_4$ consisting of hydrogen atoms, it being possible for the groups $R_1$ and/or $R_2$ to form, with the groups $R_3$ and/or $R_4$, a valence bond and/or a divalent group forming, with the two carbon atoms to which the groups $R_1$ (or $R_2$) and $R_3$(or $R_4$) are attached, a group (L) which can contain another 2-carboxycarboxamide group, and the group (L) being chosen from amongst the following cyclic or polycyclic groups:

a saturated or unsaturated cycloaliphatic radical having from 4 to 6 nuclear carbon atoms and optionally substituted by alkyl groups, halogen atoms or COOH or $NO_2$ groups, a phenyl or naphthalene radical optionally substituted by alkyl groups, halogen atoms or COOH or $NO_2$ groups, a saturated, unsaturated or aromatic heterocyclic group having 4 to 6 atoms in the ring, including a heteroatom, a saturated or unsaturated cycloaliphatic polycyclic radical or a heterocyclic polycyclic radical containing from 4 to 11 atoms, and a combination of two saturated or unsaturated cycloaliphatic groups having from 4 to 6 nuclear carbon atoms, or of two phenyl groups, joined to one another by a valence bond, an oxygen atom, a group NH or a carbonyl group, R: a valence bond or one of the following radicals:

(a) a monovalent radical consisting of a hydrogen atom, a group —$CONH_2$ or $CSNH_2$, an alkyl or alkenyl radical having from 1 to 4 carbon atoms and optionally substituted by halogen atoms, a phenyl radical which can be substituted by halogen atoms or by alkyl radicals which are themselves optionally halogenated, or a cyclohexyl or cyclopentyl radical, (b) a divalent alkylene radical having at most 6 carbon atoms or a divalent cyclohexylene, cyclopentylene or phenylene radical, or a combination of 2 to 10 alkylene groups having at most 6 carbon atoms, or of 2 to 10 phenylene groups, joined to one another by —O—, —NH— or $$-\underset{\underset{CH_3}{|}}{N}-,$$

M: an alkali metal cation or alkaline earth metal cation or a quaternary tetraalkylammonium cation, each alkyl group having from 1 to 8 carbon atoms.

Particularly advantageously, the present invention consists of the diazotype materials which can be developed by heat and of which the sensitive layer contains, as an activator precursor for the coupling reaction, a base generator containing a 2-carboxycarboxamide group of the formula (I) in which the various symbols represent the following:

$R_1$, $R_2$, $R_3$ and $R_4$: a hydrogen atom, a chlorine atom or a methyl or methoxy group, two of the groups $R_1$, $R_2$, $R_3$ and $R_4$ consisting of hydrogen atoms, it being possible for the groups $R_1$ and/or $R_2$ to form, with the groups $R_3$ and/or $R_4$, a valence bond and/or a divalent group forming, with the two carbon atoms to which the groups $R_1$ (or $R_2$) and $R_3$ (or $R_4$) are attached, a group (L) which can contain a 2-carboxycarboxamide group, and the group (L) being chosen from amongst the following cyclic or polycyclic groups:

a saturated or unsaturated cycloaliphatic radical having from 4 to 6 nuclear carbon atoms and optionally substituted by a methyl radical, chlorine atoms or COOH or $NO_2$ groups, a phenyl group optionally substituted by a methyl radical, chlorine atoms or COOH or $NO_2$ groups, a saturated or unsaturated heterocyclic group having 4 to 6 atoms in the ring, including an oxygen or nitrogen hetero-atom, a saturated or unsaturated cycloaliphatic polycyclic radical or a heterocyclic polycyclic radical having from 4 to 11 atoms, optionally including an oxygen or nitrogen hetero-atom, and a combination of two phenyl groups joined to one another by a valence bond, an oxygen atom, a group NH or a carbonyl group, R: a valence bond or one of the following radicals:

(a) a monovalent radical consisting of a hydrogen atom, a group $CONH_2$, an alkyl radical having from 1 to 4 carbon atoms, a phenyl radical optionally substituted by halogen atoms or by methyl radicals which are themselves optionally halogenated, or a cyclohexyl or cyclopentyl radical, (b) a divalent alkylene radical having at most 6 carbon atoms or a divalent cyclopentylene, cyclohexylene or phenylene radical, or a combination of 2 to 5 alkylene groups having at most 6 carbon atoms and joined to one another by an oxygen atom or a group —NH— or $$-\underset{\underset{CH_3}{|}}{N}-.$$

M: an alkaline or alkaline-earth cation or quarternary tetralkylammonium, each alkyl group having 1 to 8 carbon atoms.

Finally, of all the compounds containing 2-carboxycarboxamide groups and presented in general terms or as being preferred and advantageous, the sodium, potassium and lithium salts may be mentioned very particularly.

As already stated, the base generators according to the invention are derivatives of phthalamic, polyhydrophthalamic, succinamic or meleamic acids. These various compounds can furthermore be represented by one of the following formulae, depending on the valency of R and the valency of the cation M:

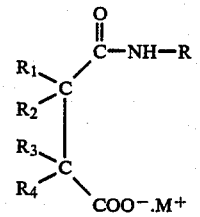

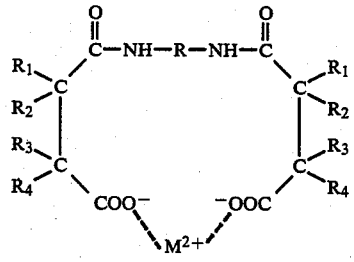

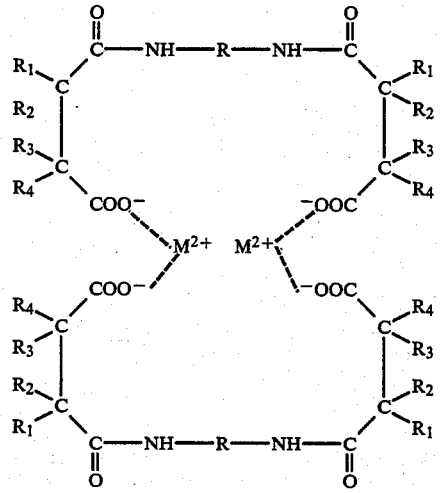

The various base generators which can be used within the scope of the present invention can easily be prepared in accordance with the techniques of the prior art, for example by reaction of the corresponding amino compounds with the acid anhydrides, followed by salification. For this purpose, reference may be made to the article in Journal of the Chemical Society, 127, page 1,791 (1925).

It will also be noted that the nature of the various substituents themselves implies the use not only of $\beta$-diacids but also of triacids or tetraacids. Thus, for example, a base generator having two 2-carboxycarboxamide groups is obtained directly from bis-$\beta$-diacids such as cyclopentane-1,2,4,5-tetracarboxylic acid.

The base generators according to the invention can optionally contain a small amount of the compounds of the 2-carboxycarboxamide type of the formula I in which the carboxyl groups are not salified. It is obvious that such mixtures can be obtained directly during the preparation of the base generator according to the invention.

The various diacids (or polyacids) which can be used for preparing the base generators can be succinic, maleamic, phthalic, dihydrophthalic, tetrahydrophthalic or hexahydrophthalic acids or optionally heterocyclic, polycyclic diacids such as bicyclo[2,2,2]octane derivatives, bicyclo[2,2,1]heptane derivatives, 7-azabicyclo[2,2,1]heptane derivatives and 7-oxabicyclo[2,2,1-]heptane derivatives. These various acids, which can contain various substituents including another 2-carboxycarboxamide group, and which have already been defined, are described, for example, in the literature and in particular in the basic chemical treatises or also in:

Rodd's chemistry of carbon compounds, second edition:

Volume I part D, Chapter 17: aliphatic dicarboxylic acids

Volume II parts A and B: alicyclic compounds

Volume III part E: phthalic acids

Volume IV parts A and F: heterocyclic compounds or in the well-known encyclopaedia:

Beilsteins Handbuch der organischen Chemie (Beilstein's Handbook of Organic Chemistry).

Purely by way of illustration, the following compounds may be mentioned amongst the diacids (or their anhydrides) or amongst the polyacids which can be used:

succinic acid and methylsuccinic acid, $\alpha,\alpha$-dimethylsuccinic acid, $\alpha,\alpha'$-diethylsuccinic acid, trimethylsuccinic acid, tetramethylsuccinic acid, monochlorosuccinic acid, monofluorosuccinic acid, $\alpha,\alpha'$-difluorosuccinic acid, $\alpha,\alpha'$-dichlorosuccinic acid, trifluorosuccinic acid, tetrafluorosuccinic acid and $\alpha$-nitrosuccinic acid;

maleic acid and dimethylmaleic acid, itaconic acid, citraconic acid, aticonic acid, methylitaconic acid and chloromaleic acid or dichloromaleic acid;

cyclobutane-1,2-dicarboxylic acid and 3,4-dichlorocyclobutane-1,2-dicarboxylic acid, 3,4-dibromocyclobutane-1,2-dicarboxylic acid, cyclopentane-1,2-dicarboxylic acid, methylcyclopentane-1,2-dicarboxylic acids, cyclopentane-1,2,4,5-tetracarboxylic acid, dihydrophthalic, tetrahydrophthalic or hexahydrophthalic acids and 4-methylhexahydrophthalic acid;

polycyclic diacids such as bicyclo[2,2,1]heptane-2,3-dicarboxylic acid, bicyclo[3,2,2]non-6-ene-2,3-dione-8,9-dicarboxylic acid, bicyclo[2,2,2]oct-5-ene-1,2-dicarboxylic acid, bicyclo[2,2,2]octane-1,2-dicarboxylic acid, bicyclo[2,2,2]oct-7-ene-2,3,5,6-tetracarboxylic acid, B 1,4,5,6,7,7-hexachlorobicyclo[2,2,1]hept-5-ene-2,3 dicarboxylic acid and tricyclo[4,2,2,$0^{2,5}$]deca-3,7-diene-9,10-dicarboxylic acid;

phthalic acids, namely ortho-phthalic acid, 3-chlorophthalic acid, 4-chlorophthalic acid, 3-methoxyphthalic acid, 3,5-dimethoxyphthalic acid, 3,6-dimethylphthalic acid, 4-nitrophthalic acid, 3,4,5,6-tetrachlorophthalic acid, 4-carboxyphthalic acid and benzophenone-3,4,3',4'-tetracarboxylic acid;

the following heterocyclic acids: furan-2,3,5-tricarboxylic acid, benzofuran-2,3-dicarboxylic acid and pyridine-3,4-dicarboxylic acid; and heterocyclic polycyclic diacids such as 7-oxabicyclo[2,2,1]hept-5-ene, -2,3 dicarboxylic acid.

Amongst the various monoamines or polyamines which can be used for preparing the various base generators, there may be mentioned ammonia, hydrazine, aliphatic, cycloaliphatic or aromatic primary monoamines, aliphatic or aromatic primary diamines, and polyamines optionally containing hetero-atoms, such as the polyamines of the formulae: $NH_2$—$[(CH_2)_{m'}$—$NH]_m$—H or $NH_2$—$[(CH_2)_{m'}$—$O]_{m-1}$—$(CH_2)_{m'}$—$NH_2$, m' being an integer between 2 and 6.

By way of illustration, the following may be mentioned in particular: ammonia, butylamine, cyclohexylamine, hydrazine, aniline, chloroaniline, trifluoromethylaniline, toluidine, xylidine, 4,4'-diaminodiphenylmethane, 4,4'-diaminodiphenyl ether, ethylenediamine, hexamethylenediamine, cyclohexylenediamine and the like.

Finally, amongst the various base generators which can be used according to the invention, there could be mentioned, by way of illustration, the compounds of the formula I in which the various symbols correspond exactly to the substituents carried by the acid anhydride (or the diacid or polyacid) and the amine (or the diamine) used to prepare them, which have just been mentioned by name. Amongst these compounds, the sodium and potassium salts of N,N'-polymethylene-bis-phthalamic, N,N'-polymethylene-bis-hexahydrophthalamic, N,N'-polymethylene-bis-succinamic and N,N'-polymethylene-bis-maleamic acids may obviously be mentioned very particularly.

The diazotype materials according to the invention can vary in nature and are applied in any field in which the use of a base generator can be recommended and in which the process of developing the coloured image at least involves a heating step. Thus, in general, this is a dry thermal process in which, in addition to the binder, the sensitive layer contains at one and the same time a diazonium salt, a coupler, a base generator and, optionally, the various additional compounds well known to those skilled in the art (acid stabiliser, reducing agent, UV inhibitor, humectant, contrast modifier and th like); this process thus leads directly to a positive.

The diazotype materials can also be those which can be developed by heat and of which the sensitive layer contains a diazonium salt and a base generator, the coupler being generated directly by photolysis of the diazonium salt. This process thus leads directly to a negative.

It is also possible to obtain positive images from diazotype products according to the invention, of which the sensitive layer contains a diazonium salt and a base generator, the developing, after exposure, being ensured by a semi-wet process in which the diazotype paper is wetted, under hot conditions, by a solution of a coupler.

Finally, it is also possible, according to the invention, to manufacture diazotype materials which can be used for copying opaque originals by a reflex process in which exposure is initially carried out using infra-red radiation, and then, in a second stage, the residual diazonium salt is destroyed, for example by exposure to intense ultraviolet radiation.

These various processes and the corresponding diazotype materials together depend, other than on the nature of the base generator, which is the characteristic feature according to the invention, on the customary diazotype printing technique such as described, for example, in the work by J. KOSAR in 1965, entitled "Light-sensitive systems chemistry and application of non silver halide photographic systems". It is quite obvious that it is also possible to use several diazonium salts and/or several couplers simultaneously.

In one variant, at least one of the main constituents of the diazotype material of the invention can be introduced encapsulated by any material which can be used for this purpose.

One of the preferred diazotype materials according to the invention consists of a material of which the sensitive layer contains a diazonium salt, a coupler and a base generator. The diazonium salt can vary in nature provided that, as described in the abovementioned work by J. KOSAR, the photolysis decomposition products are not themselves a coloured agent or an active coupler. In this context, the various diazonium salts having a high coupling activity and an absorption maximum which is greater than or equal to 400 nm are suitable. These diazos, which are preferably chosen from amongst compounds permitting rapid coupling and consequently highspeed printing, can be diazonium salts containing the cation $[Z(N_2^+)_x]$, x being a number equal to 1 or 2. The salt can be a chlorozincate, a chloride, a sulphate, a sulphonate, a chlorostannate, a borofluoride, a hexafluoride or the like, without implying a limitation. Z represents a radical which contains a benzene nucleus directly joined to the diazo group and contains from 6 to 30 carbon atoms, and which can be chosen from amongst the following radicals:

1. monovalent radicals containing a single benzene nucleus and having the formula (II)

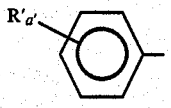

(II)

in which a' represents an integer equal to 0, 1 or 2 and in which R' represents a hydrogen atom, a chlorine atom, a hydroxyl group, an alkyl group having at most 4 carbon atoms, an alkoxy group having at most 4 carbon atoms, the group $N(R'_1, R'_2)$ ($R'_1$ and $R'_2$ representing a hydrogen atom or an alkyl radical having at most 4 carbon atoms), a phenyl, tolyl, xylyl or cyclohexyl radical or a radical $SO_3H$, $SO_3Na$, $SO_2NH_2$ or COOH.

2. monovalent radicals containing two benzene nuclei and having the formula (III)

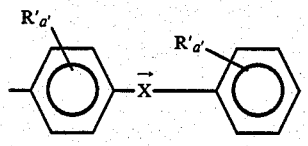

(III)

in which a' and R' have the same meaning as those given for the radicals of the formula (II) and in which $\vec{X}$ represents a valence bond, an oxygen atom, a sulphur atom or one of the following groups:

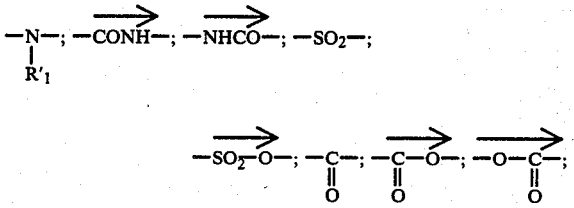

$R'_1$ having the same meaning as that given for the radicals of the formula (II).

3. monovalent radicals containing a heterocyclic radical and having the formula (IV)

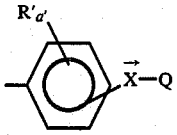

(IV)

in which a', R' and $\vec{X}$ have the same meaning as those given for the radical (III) and in which Q represents one of the following heterocyclic groups:

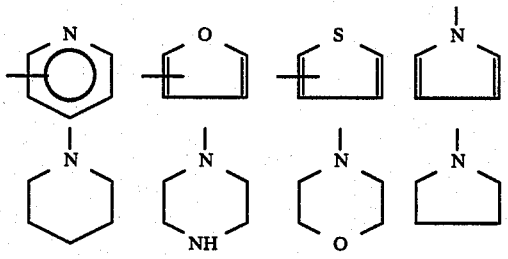

piperidyl piperazyl morpholinyl pyrrolidinyl

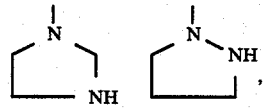

imidazolidinyl pyrazolidinyl it also being possible for these various radicals Q to be substituted by one or two methyl groups.

4. polycyclic radicals (V) chosen from amongst naphthyl, phenanthrenyl, anthracenyl, quinolyl and isoquinolyl radicals.

5. divalent radicals having one of the following formulae:

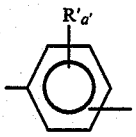

(VI)

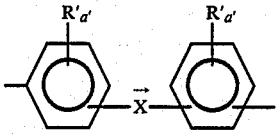

(VII)

the symbols R', a' and $\vec{X}$ having one of the meanings given for the radicals of the formula (III).

Z will advantageously be chosen from amongst the following radicals:

(1) Monovalent radicals chosen from amongst the following radicals:

1.1. radicals of the formula (II)'

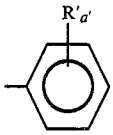

in which a' has the meaning given above and in which R' represents a hydrogen atom, a chlorine atom, a hydroxyl group, a methyl or ethyl group, a methoxy or ethoxy group, a group $NH_2$ or $—N(R'_1R'_2)$ ($R'_1$ and $R'_2$ representing a hydrogen atom, a methyl or ethyl radical or a phenyl radical) or a radical $SO_3H$, $SO_3Na$ or $SO_2NH_2$.

1.2. a radical of the formula (III)'

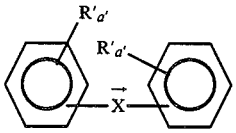

in which R' and a' have one of the meanings given for the radicals of the formula (II)' and in which X represents a valence bond, an oxygen atom, a sulphur atom or a group —NH—, —CONH—, —NHCO— or $—SO_2—$.

1.3. a radical of the formula (IV)'

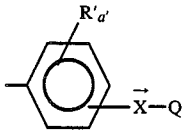

in which R', a' and X have one of the meanings given for the radicals of the formula (III)' and in which Q represents one of the following heterocyclic radicals:

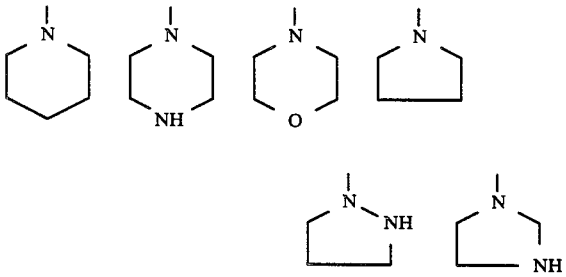

1.4. the naphthyl radical (2) Divalent radicals having one of the following formulae:

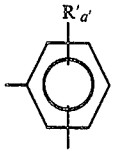

(VI)'

-continued

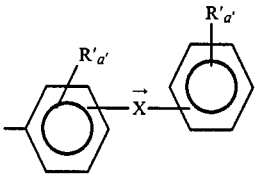

(VII)' the symbols R', X and a' having one of the meanings given for the radicals of the formula (III)'.

By way of illustration, the radicals having one of the following formulae may be mentioned amongst the radicals Z:

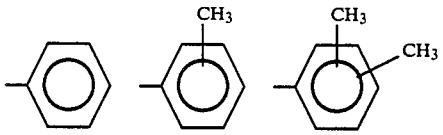

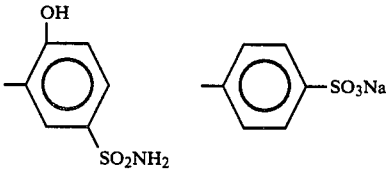

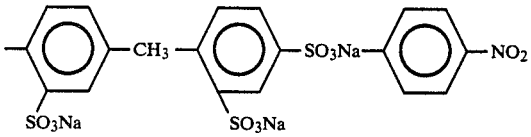

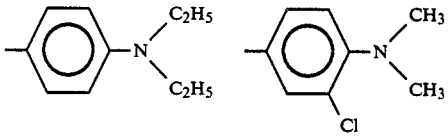

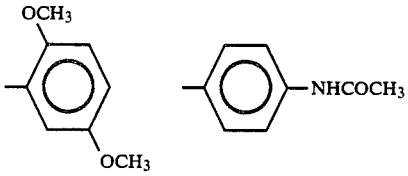

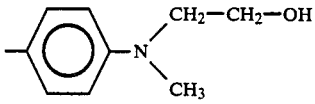

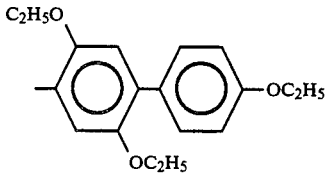

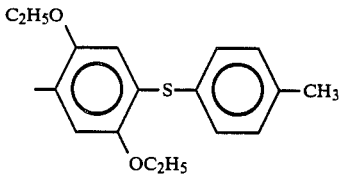

-continued

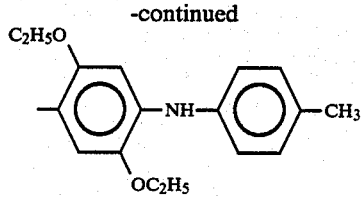

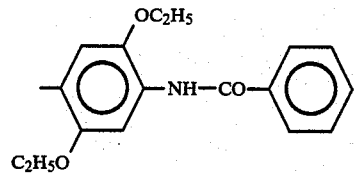

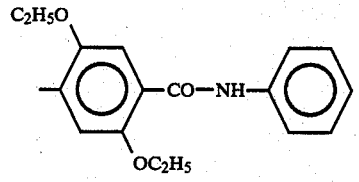

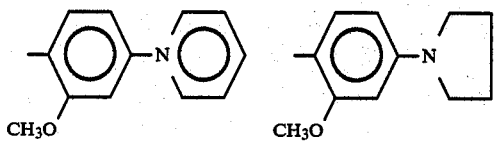

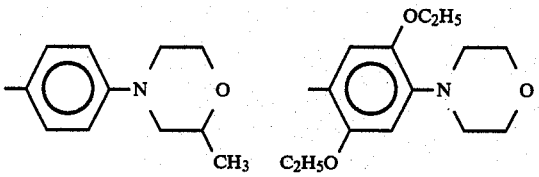

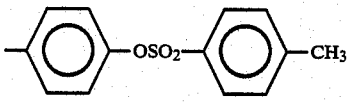

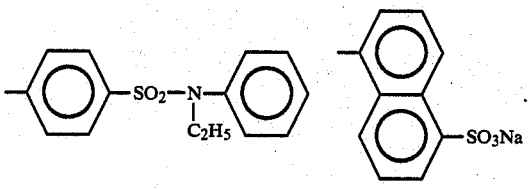

The coupling agent itself can vary greatly in nature. For this purpose, reference may be made to the above-mentioned work by J. KOSAR or to the work by Kirk-Othmer, entitled "Encyclopedia of Chemical Technology," 1978 edition, Volume 3—Azodyes—page 387 et seq.. The coupler is generally a phenolic compound, which can be a monophenol optionally substituted by various groups such as halogen atoms or alkyl, alkoxy, hydroxyalkyl, hydroxyalkoxy, amino, sulphamido, sulpho or carboxyl groups, and/or which can contain urea and thiourea groups; it is known that couplers of this type generally give yellow or light brown compounds.

The coupling agent can be a polyphenol or its derivatives produced from pyrocatechol, resorcinol, aminoresorcinol, resorcylic acid and hydroquinone, and containing substituents such as those which have been defined above in the context of monophenols. The coupler can also be a trihydroxybenzene or one of its derivatives, such as phloroglucinol or its derivatives. The coupler can also be a derivative of phenolic type from the biphenyl or naphthalene series; in this context, there may be mentioned trihydroxybiphenyls or tetrahydroxybiphenyls, naphthols, hydroxynaphthoic acid and their derivatives, naphthalenediols, these various compounds being optionally substituted by the various groups such as defined above, or used in the form of derivatives of their functional groups. Finally, couplers which may be mentioned are various non-phenolic compounds such as $\beta$-diketones, acetonitriles, cyanacetylamides, sulphonamides, acetoacetic acid derivatives, alkyl malonamates, pyronones, hydroxypyridones, oxyquinolones, pyrazolones, thiophene derivatives and the like.

The use, as couplers, of 2-aryl-2H-benzotriazoles carrying phenolic hydroxyl groups may also be mentioned, and the various compounds which follow may be mentioned amongst these: 2-(2'-hydroxyphenyl)-2H-benzotriazole, 5-chloro-2-(2'-hydroxyphenyl)-2H-benzotriazole, 5-ethyl-2-(2'-hydroxyphenyl)-2H-benzotriazole, 5,6-dichloro-2-(2'-hydroxyphenyl)-2H-benzotriazole, 2-(2',5'-dihydroxyphenyl)-2H-benzotriazole, 2-(2',4'-dihydroxyphenyl)-2H-benzotriazole, 2-(2',4'-dihydroxy-5'-chlorophenyl)-2H-benzotriazole, 2-(2',4'-dihydroxy-5'-nitrophenyl)-2H-benzotriazole, 5-chloro-2-(2',4'-dihydroxyphenyl)-2H-benzotriazole, 2-(2'-hydroxy-5'-methoxyphenyl)-2H-benzotriazole.

The use of couplers of this type is advantageous because the azo dyestuffs which result therefrom are particularly stable to light and to UV radiation.

To obtain the different colours required in diazotype printing, it may be necessary to use a mixture of various couplers and/or of diazonium salts. The proportions of the diazonium salt to the coupler are in accordance with the usual limits which are well known to those skilled in the art, that is to say between 0.3 and 3. As regards the amount of base generator, this is usually such that there are from 0.1 to 5 g and preferably from 0.5 to 3 g of base generator per $m^2$ of sensitive layer.

Depending on the diazotype material manufactured, the various usual adjuvants which are well known to those skilled in the art will be added. Thus, the use of acid stabilisers such as organic or inorganic acids, for example oxalic acid, citric acid, tartaric acid, para-toluenesulphonic acid, phosphoric acid and the like, may be mentioned.

Finally, the diazotype materials according to the invention can be manufactured in accordance with the customary techniques, in monolayers or, optionally, in multilayers, using any suitable base material such as paper, paper provided with a solvent-resistant layer, polyester, varnished tracing paper or cellulose acetate.

It will be observed that, in the process of the present invention, the base generator can be coated on the same side as the other main reactive constituents of the sensitive layer. Therefore, there is no limitation as regards the choice of the base material, which can be a paper or a film. This is also an advantage compared with the current processes, in which the base generator is applied to the back, which necessarily entails the use of paper as film is unsuitable.

The diazotype materials according to the invention are exposed, using a UV source, through a transparent or semi-transparent original or by the reflex process. Thermal developing is ensured by heating to a temperature between 80° and 160° C. and preferably between 100° and 140° C.

Finally, a further subject of the present invention consists of a diazo copying process in which a coloured image is created by selectively reacting a diazonium salt with a coupler, the process being characterised in that the diazotype materials used are the diazotype materials according to the invention.

The examples which follow illustrate the invention.

EXAMPLE 1

A precoat dispersion which is well known to those skilled in the art, containing:

| | |
|---|---|
| 10% strength dextrin solution | 300 $cm^3$ |
| Syloid 244 (silica from GRACE) | 50 g |
| Na salt of N,N'—ethylene-bis-phthalamic acid | 80 g |
| water q.s.p. | 1 liter |

is prepared.

This dispersion is applied to the surface of a heliographic paper at a rate of 12 $g/m^2$, using an air knife, and dried.

The diazo solution, containing:

| | |
|---|---|
| citric acid | 30 g |
| thiourea | 30 g |
| 2,3-dihydroxynaphthalene | 16 g |
| 4-diazo-2,5-diethoxy-N—phenylmorpholine | 12 g |

per liter, is applied to the surface of the precoat at a rate of 15 $g/m^2$, using a Meyer bar, and dried at 90° C.

After exposure under a positive original, the sheet is developed in a thermal developing machine, the heated roller of which reaches 140° C.

A positive blue image of the original is obtained.

Optical density measured using a Macbeth TR/R: 1.25.

Background whiteness measured on a Photovolt: 83.

EXAMPLE 2

This example is the same as Example 1, the Na salt of N,N'-ethylene-bis-phthalamic acid being replaced, in the precoat, by the tetrabutylammonium salt.

The conditions of surface application and drying are the same and the sensitive layer is the same. After exposure and developing, a blue-violet positive image of the original is obtained.

Optical density: 1.30.

Background whiteness: 86.

EXAMPLE 3

This example is the same as Example 1, the Na salt of N,N'-ethylene-bis-phthalamic acid being replaced, in the precoat, by the Na salt of N,N'-ethylene-bis-succinamic acid.

Under the same conditions of surface application, coating and drying, and with the same sensitive layer, a blue image is obtained at a developing temperature of 125° C.

Optical density: 1.25.

Background whiteness: 85.

EXAMPLE 4

This example is the same as Example 1, the Na salt of N,N'-ethylene-bis-phthalamic acid being replaced, in the precoat, by the Na salt of N,N'-ethylene-bis-maleamic acid.

In this case, a blue image of the original is obtained at 130° C.

Optical density: 1.20.

Background whiteness: 84.

EXAMPLE 5

The precoat is as in Example 2.

The diazo solution contains:

| | |
|---|---|
| citric acid | 20 g |
| thiourea | 30 g |
| urea | 30 g |
| 2,3-dihydroxynaphthalene | 16 g |
| N,N'—diacetoacetylethylenediamine | 4 g |
| 4-diazo-2,5-diethoxy-N—phenylmorpholine | 12 g |

per liter.

After drying, exposure and printing, a positive black image of the original is obtained in a thermal developing machine at about 140°.

Optical density: 1.

Background whiteness: 83.

EXAMPLE 6

A precoat dispersion containing:

| | |
|---|---|
| sodium casein | 30 g |
| silica | 40 g |
| base generator | 80 g |
| water q.s.p. for 1,000 ml | |

is prepared.

This dispersion is applied to the surface of a base material for diazotype printing, using an air knife, and then dried.

A diazo solution containing the following ingredients:

| | |
|---|---|
| sodium 2,3-dihydroxynaphthalene-7-sulphonate | 20 g |
| 4-diazo-2,5-diethoxy-N—phenylmorpholine | 12 g |
| citric acid | 20 g |
| urea | 30 g |
| thiourea | 30 g |
| glycerine | 20 g |
| water q.s.p. for 1,000 ml | |

is applied to the surface of the precoat, using a Meyer bar, and dried at 80° C.

After exposure under a positive original, the sheet is developed in a thermal developing machine at 140° C. A positive blue image of the original is obtained.

The background whiteness (designated by W) and the optical density (designated by OD) are measured. These measurements are carried out as soon as possible after developing (time 0) and then after ageing for 30 days in a black polyethylene envelope.

The results are as follows:

| BASE GENERATOR | | TIME O | | AFTER AGEING for 30 days | |
|---|---|---|---|---|---|
| ACID PART | BASIC PART | W | OD | W | OD |
| 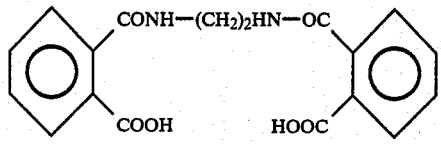 | Sodium | 82 | 1.20 | 79 | 1.05 |
| | Lithium | 83 | 1.00 | 82 | 1.00 |
| | Potassium | 83 | 1.00 | 82 | 1.00 |
| | Tetrabutyl-ammonium | 82 | 1.10 | 78 | 1.10 |
| | Tetraethyl-ammonium | 83 | 1.06 | 78 | 1.06 |
| | Tetramethyl-ammonium | 83 | 1.00 | 80 | 1.00 |

It will be noted that the starting paper has a background whiteness equal to at most 90. Furthermore, the images of which the background whiteness is less than 75 and in which the optical density is less than or equal to 0.75 cannot be considered as acceptable.

By way of comparison, an experiment was carried out with a tributylamine salt of N,N'-ethylene-bis-phthalamic acid. It is observed that the image develops poorly and an increase in the background is produced (OD: 0.30).

Furthermore, it is observed that the background continues to increase during storage in a black polyethylene envelope.

EXAMPLE 7

The same experiment is carried out as in Example 6, a calcium or magnesium salt of an N,N'-ethylene-bis-phthalamic acid being used as the base generator. A coloured image is obtained, the optical density of which is more than 0.75.

EXAMPLES 8 TO 33

Following the procedure of Example 6, various coloured images are created by changing the nature of the base generator. The results are shown in the table which follows.

| BASE GENERATOR | | | |
|---|---|---|---|
| ACID PART | BASIC PART | TIME O W | TIME O OD |
| 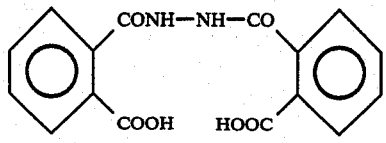 | Sodium | | 1.00 |
| 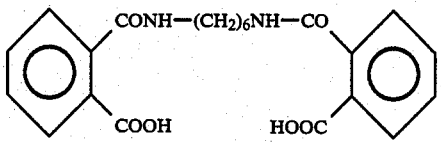 | Sodium | | 1.00 |
| 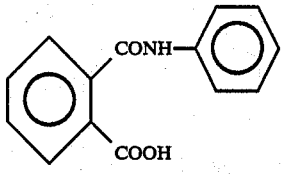 | Sodium | 82 | 0.8 |
| 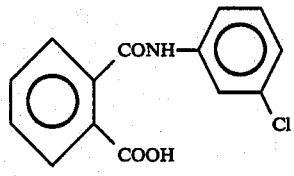 | Sodium | 78 | 0.8 |
| 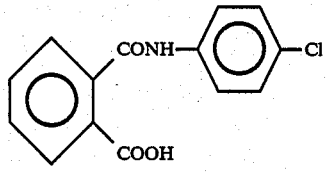 | Sodium | 84 | 0.90 |

-continued
| BASE GENERATOR | | | |
|---|---|---|---|
| ACID PART | BASIC PART | TIME O W | TIME O OD |
| 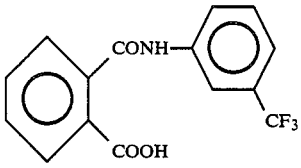 | Sodium | 84 | 0.8 |
| 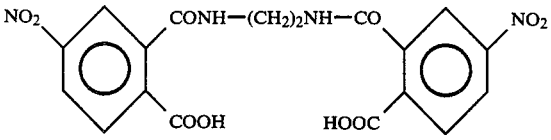 | Sodium | 82 | 0.80 |
| 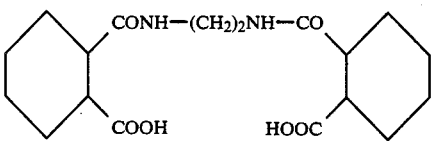 | Sodium | 86 | 1.20 |
| 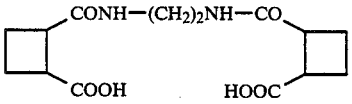 | Sodium | 87 | 1.20 |
| 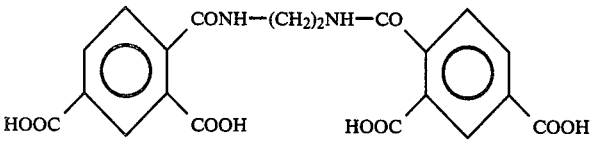 | Sodium | 82 | 0.80 |
| 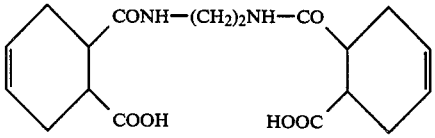 | Sodium | 87 | 1.00 |
| 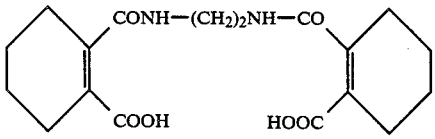 | Sodium | 81 | 1.20 |
| 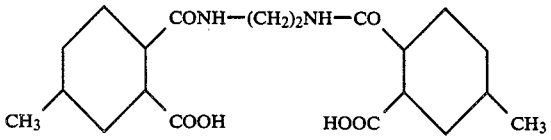 | Sodium | 88 | 0.90 |
| 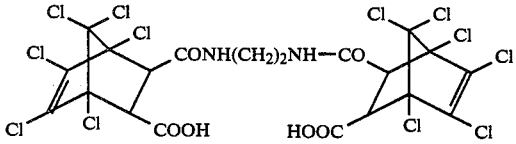 | Sodium | 85 | 0.75 |

-continued
| BASE GENERATOR | | | |
|---|---|---|---|
| ACID PART | BASIC PART | TIME O W | TIME O OD |
| 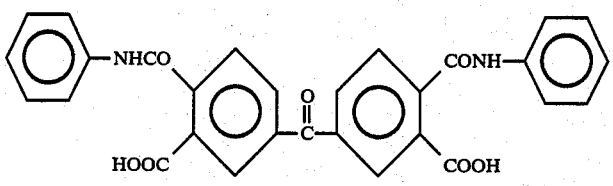 | Sodium | 77 | 0.75 |
| 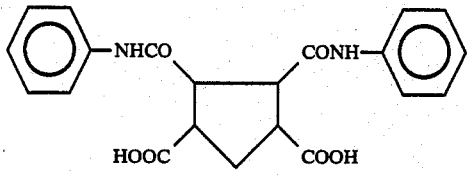 | Sodium | 83.5 | 0.90 |
| 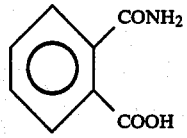 | Sodium | 86 | 1.20 |
| 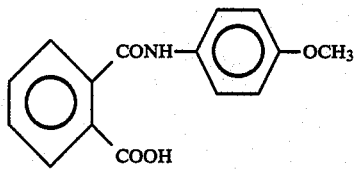 | Sodium | 75 | 0.80 |
| 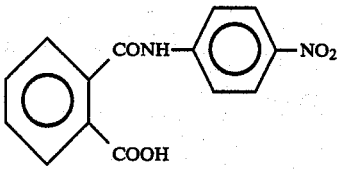 | Sodium | Canary yellow back-ground | 0.80 |
| 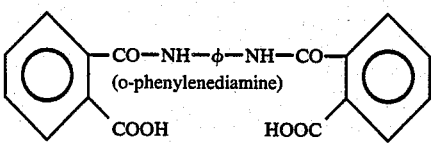 | Sodium | 83 | 0.75 |
| 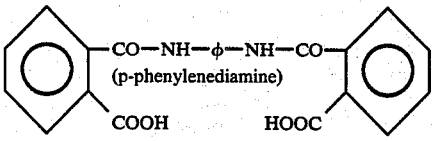 | Sodium | 82 | 0.90 |
| 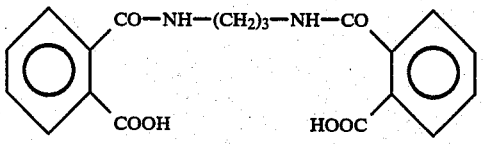 | Sodium | 86 | 1.20 |
| 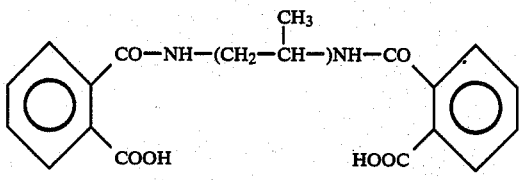 | Sodium | 86 | 1.05 |

-continued

| BASE GENERATOR | | | |
|---|---|---|---|
| ACID PART | BASIC PART | TIME O W | TIME O OD |
| 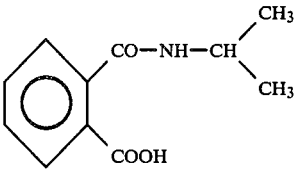 | Sodium | 85 | 1.30 |
| 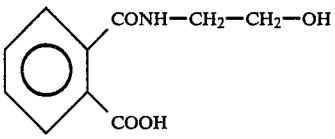 | Sodium | 85 | 1.20 |
| 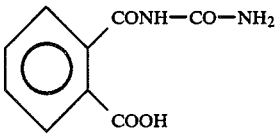 | Sodium | 82 | 0.90 |

EXAMPLE 34

The procedure of Example 6 is followed, starting from 100 g/liter of the sodium salt of N,N'-ethylene-bis-phthalamic acid; the citric acid is replaced by 10 g/liter of p-toluenesulphonic acid. Furthermore, no glycerine is added. A coloured image is obtained, the background whiteness of which is 84, and the optical density is 1.30. After ageing for 30 days, the background whiteness is 80 and the optical density remains at 1.30.

EXAMPLE 35

A first bath, which contains the diazo compound and the coupler:

| | |
|---|---|
| thiourea | 30 g |
| urea | 30 g |
| sodium 2,3-dihydroxynaphthalene-6-sulphonate | 30 g |
| citric acid | 15 g |
| 4-diazo-2,5-diethoxy-N—phenylmorpholine | 20 g |
| aqueous dispersion of a polyvinyl acetate | 25 $cm^3$ |
| silica (particle size: 3 to 5μ) | 40 g |
| polyvinyl alcohol (Rhodoviol 5/270) ® | 20 g |
| water (amount required for one liter of bath) | |

is prepared, and then a second bath, containing the base generator:

| | |
|---|---|
| salt of tetramethylammonium hydroxide of N,N'—ethylene-bis-maleamic acid | 60 g |
| aluminium sulphate | 5 g |
| aqueous dispersion of a polyvinyl acetate | 25 $cm^3$ |
| silica (Aerosil 200) ® | 3 g |
| water (amount required for one liter of bath) | |

is prepared.

One after the other, these two mixtures are applied to the surface of a paper base material, on the same side, and dried.

After exposure under a positive original, the sheet is developed in a thermal machine, the roller of which is at 130° C.

A positive blue image of the original is obtained.
Optical density: 1.30.
Whiteness: 82.

EXAMPLE 36

A precoat dispersion, containing the couplers:

| | |
|---|---|
| polyvinyl alcohol (Rhodoviol 4/20) ® | 20 g |
| methyl alcohol | 50 $cm^3$ |
| sodium 2,3-dihydroxynaphthalene-6-sulphonate | 20 g |
| N,N'—diacetoacetylethylenediamine | 4 g |
| citric acid | 15 g |
| aqueous dispersion of a polyvinyl acetate | 25 $cm^3$ |
| silica (particle size: 3 to 5μ) | 40 g |
| water (amount required for one liter of bath) | |

is prepared, and then a second bath, containing the diazo compound and the base generator:

| | |
|---|---|
| thiourea | 30 g |
| urea | 30 g |
| 4-diazo-2,5-diethoxy-N—phenylmorpholine | 20 g |
| citric acid | 5 g |
| sodium salt of N,N'—ethylene-bis-phthalamic acid | 100 g |
| water (amount required for one liter of bath) | |

is prepared.

One after the other, these two baths are applied, in order, to the surface of a paper base material for diazo-type printing, on the same side, and dried.

After exposure under a positive original, the copy is developed in a thermal machine, the roller of which reaches a temperatures of 130° C.

A positive black image of the original is obtained.
Optical density: 1.15.
Whiteness: 82.

EXAMPLE 37

The following bath:

| | |
|---|---|
| citric acid | 15 g |
| thiourea | 30 g |
| urea | 30 g |
| glycerine | 10 $cm^3$ |
| sodium 2,3-dihydroxynaphthalene-6-sulphonate | 25 g |
| 4-diazo-2,5-diethoxy-N—phenylmorpholine | 25 g |
| silica (particle size: 3 to 5μ) | 30 g |
| aqueous dispersion of polyvinyl acetate (Mowilith DC) ® | 40 $cm^3$ |
| salt of tetrabutylammonium hydroxide of N,N'—ethylene-bis-phthalamic acid | 50 g |
| water (amount required for one liter of bath) | |

is prepared.

This mixture is applied to the surface of a paper base material, levelled with an air knife and then dried.

After exposure and developing, a blue positive image of the original is obtained.

EXAMPLE 38

A matting layer consisting of:

| | |
|---|---|
| methyl ethyl ketone | 320 $cm^3$ |
| cellulose acetopropionate resin | 90 g |
| silica | 30 g |
| methanol | 180 $cm^3$ |
| salt of tetrabutylammonium hydroxide of N,N'—ethylene-bis-phthalamic acid | 50 g |

is coated onto a poly-(ethylene glycol)terephthalate base material at a rate of 8 $g/m^2$.

After drying, a sensitive varnish containing:

| | |
|---|---|
| methanol | 500 $cm^3$ |
| cellulose acetopropionate resin | 90 g |
| tartaric acid | 8 g |
| sulphosalicylic acid | 5 g |
| thiourea | 5 g |
| diresorcyl sulphide | 15 g |
| 4-diazo-3-methyl-N—phenylpyrrolidine | 12 g |

is applied on top at a rate of 4 $g/m^2$.

After drying at a temperature of 60°–70° C., the sheet is exposed to UV under a positive original and developed in a thermal machine at a temperature of 120° C. A sepia positive image of the original is obtained.

EXAMPLE 39

A matting varnish containing:

| | |
|---|---|
| methyl ethyl ketone | 320 $cm^3$ |
| silica | 30 g |
| cellulose acetopropionate resin | 90 g |
| methanol | 180 $cm^3$ |
| tartaric acid | 8 g |
| sulphosalicylic acid | 8 g |
| thiourea | 5 g |
| diresorcyl sulphide | 15 g |
| 4-diazo-3-methyl-N—phenylpyrrolidine | 10 g |
| salt of tetramethylammonium hydroxide of N,N'—ethylene-bis-phthalamic acid | 60 g |

is deposited onto a poly-(ethylene glycol)terephthalate base material at a rate of 10 $g/m^2$.

After drying at 70° C. and exposure to UV under an original, a sepia counter-imagewise negative having a good opacity to ultra-violet radiation is obtained by passing the sheet through a thermal machine at 120° C.

We claim:

1. A heat-developable diazotype material comprising a base material as a support and a multilayer sensitive layer supported on the base material and which contains as essential ingredients a diazonium salt, a coupler and a base generator as an activator precursor for the coupling reaction generating a coloured trace from said diazonium salt and said coupler, wherein no more than two of the essential ingredients are present in any one layer of the multilayer sensitive layer, the base generator being a salt comprising a basic component and an acid component, and the acid component being a 2-carboxycarboxamide group, the diazotype materials being characterized in that the basic component of the base generator consists of an alkali metal cation.

2. The diazotype material according to claim 1, characterised in that the base generator is a compound of the general formula (I):

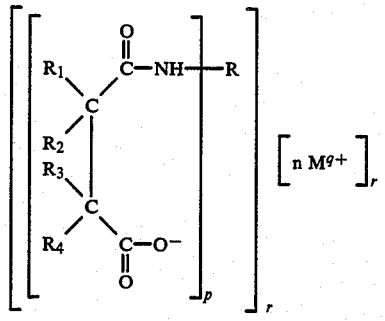

in which the various symbols represent the following:

$R_1$, $R_2$, $R_3$ and $R_4$: a hydrogen atom, a halogen atom or an alkyl, halogenoalkyl, alkoxy, alkoxycarbonyl, hydroxyl, carbamoyl or carboxamide group, or the groups $R_1$ and/or $R_2$ may form, with the groups $R_3$ and/or $R_4$, a valence bond and/or a divalent group forming, with the two carbon atoms to which the groups $R_1$ (or $R_2$) and $R_3$ (or $R_4$) are attached, a group (L) which may contain another 2-carboxycarboxamide group, and the group (L) being cyclic or polycyclic or or the group (L) consists of a combination of several cyclic groups joined to one another by a valence bond, a hetero-atom or a methylene or carboxyl group, R: an integer equal to 1 or 2, p: an integer equal to 1 or 2 and representing the valence of the symbol R, R: a valence bond or one of the following radicals:

(a) a monovalent radical consisting of a hydrogen atom, a group —$CONHR_5$ or —$CSNHR_5$, $R_5$ being a hydrogen atom, an alkyl radical, a saturated or unsaturated aliphatic or cycloaliphatic hydrocarbon radical, or an aromatic radical; or any one of the foregoing radicals substituted by alkyl groups, halogenated alkyl groups, halogen atoms, carboxyl groups, nitro groups, urea groups, thiourea groups or hydroxyl groups; or (b) a divalent alkylene, cycloalkylene or phenylene radical or a combination of alkylene or phenylene groups joined to one another by a hetero-atom or a group $$-\underset{\underset{R_5}{|}}{N}-,$$

$R_5$ representing a hydrogen atom or an alkyl group,

M: an alkali metal cation or alkaline earth metal cation of valence q or a quaternary tetralkylammonium cation, and n: an integer equal to 1 or 2 and such that the overall ionic charge on the base generator is zero.

3. The diazotype material according to one of claim 1, chacterised in that the base generator is a compound of the general formula (I) in which the various symbols represent the following:

$R_1$, $R_2$, $R_3$ and $R_4$: a hydrogen atom, a chlorine atom or an alkyl or alkoxy group having from 1 to 4 carbon atoms, two of the groups $R_1$, $R_2$, $R_3$ and $R_4$ consisting of hydrogen atoms, or the groups $R_1$ and/or $R_2$ may form, with the groups $R_3$ and/or $R_4$, a valence bond and/or a divalent group forming, with the two carbon atoms to which the groups $R_1$ (or $R_2$) and $R_3$ (or $R_4$) are attached, a group (L) which can contain another 2-carboxycarboxamide group, and the group (L) being selected from the group consisting of the following cyclic or polycyclic groups:

a saturated or unsaturated cycloaliphatic radical having from 4 to 6 nuclear carbon atoms, or said radicals substituted by alkyl groups, halogen atoms or COOH or $NO_2$ groups, a phenyl or naphthalene radical or said radical substituted by alkyl groups, halogen atoms or COOH or $NO_2$ groups, a saturated, unsaturated or aromatic heterocyclic group having 4 to 6 atoms in the ring, including a hetero atom, a saturated or unsaturated cycloaliphatic polycyclic radical or a heterocyclic polycyclic radical containing from 4 to 11 atoms, and a combination of two saturated or unsaturated cycloaliphatic groups having from 4 to 6 nuclear carbon atoms, or of two phenyl groups, joined to one another by a valence bond, an oxygen atom, a group NH or a carbonyl group, R: valence bond or one of the following radicals:

(a) a monovalent radical consisting of a hydrogen atom, a group $-CONH_2$ or $CSNH_2$, an alkyl or alkenyl radical having from 1 to 4 carbon atoms, or said radical substituted by halogen atoms, a phenyl radical which can be substituted by halogen atoms or by alkyl radicals or halogenated alkyl radicals, or a cyclohexyl or cyclopentyl radical, or (b) a divalent alkylene radical having at most 6 carbon atoms or a divalent cyclohexylene, cyclopentylene or phenylene radical, or a combination of 2 to 10 alkylene groups having at most 6 carbon atoms, or of 2 to 10 phenylene groups, joined to one another by —O—, —NH— or $$-\underset{\underset{CH_3}{|}}{N}-,$$

M: an alkali metal cation or alkaline earth metal cation or a quaternary tetraalkylammonium cation, each alkyl group having from 1 to 8 carbon atoms.

4. The diazotype material according to claim 1, characterised in that the base generator is a compound of the general formula (I) in which the various symbols represent the following:

$R_1$, $R_2$, $R_3$ and $R_4$: a hydrogen atom, a chlorine atom or a methyl or methoxy group, two of the groups $R_1$, $R_2$, $R_3$ and $R_4$ consisting of hydrogen atoms, or the groups $R_1$ and/or $R_2$ may form, with the groups $R_3$ and/or $R_4$, a valence bond and/or a divalent group forming, with the two carbon atoms to which the groups $R_1$ (or $R_2$) and $R_3$ (or $R_4$) are attached, a group (L) which can contain a 2-carboxycarboxamide group, and the group (L) being selected from the group consisting of the following cyclic or polycyclic groups:

a saturated or unsaturated cycloaliphatic radical having from 4 to 6 nuclear carbon atoms or said radical substituted by a methyl radical, chlorine atoms or COOH or $NO_2$ groups, a phenyl group, or phenyl substituted by a methyl radical, chlorine atoms or COOH or $NO_2$ groups, a saturated or unsaturated heterocyclic group having 4 to 6 atoms in the ring, including an oxygen or nitrogen hetero-atom, a saturated or unsaturated cycloaliphatic polycyclic radical or a heterocyclic polycyclic radical having from 4 to 11 atoms, or said radical including an oxygen or nitrogen hetero-atom, and a combination of two phenyl groups joined to one another by a valence bond, an oxygen atom, a group NH or a carbonyl group, R: a valence bond or one of the following radicals:

(a) a monovalent radical consisting of a hydrogen atom, a group $CONH_2$, an alkyl radical having from 1 to 4 carbon atoms, a phenyl radical, a phenyl radical substituted by halogen atoms or by methyl radicals or by halogenated methyl radicals, or a cyclohexyl or cyclopentyl radical, or (b) a divalent alkylene radical having at most 6 carbon atoms or a divalent cyclopentylene, cyclohexylene or phenylene radical, or a combination of 2 to 5 alkylene groups having at most 6 carbon atoms and joined to one another by an oxygen atom or a group —NH or $$-\underset{\underset{CH_3}{|}}{N}-,$$

M: an alkali metal cation or alkaline earth metal cation or quaternary tetraalkylammonium, each alkyl group having from 1 to 8 carbon atoms.

5. The diazotype material according to claim 1, characterised in that the basic component is a sodium, potassium or lithium cation.

6. The diazotype material according to claim 1, characterised in that the base generator is a compound derived from a phthalamic acid.

7. The diazotype material according to claim 1, characterised in that the base generator is a compound derived from a maleamic acid.

8. The diazotype material according to claim 1, characterised in that the base generator is a compound derived from a succinamic acid.

9. The diazotype material according to claim 1, characterised in that the base generator is a compound derived from a polyhydrophthalamic acid.

10. A two-component diazotype material according to claim 1 wherein the sensitive layer comprises a photosensitive layer containing said diazonium salt and said coupler and a second layer adjacent thereto containing said base generator.

11. A two-component diazotype material according to claim 1 wherein said sensitive layer comprises a photosensitive layer containing said diazonium salt and said base generator and adjacent thereto a second layer containing said coupler.

12. The diazotype material according to claim 1 wherein the sensitive layer contains said diazonium salt and said coupler at a weight ratio of from 0.3/1 to 3/1 and the amount of base generator is from 0.1 to 5 $g/m^2$.

13. The diazotype material according to claim 1 wherein the basic component is a sodium cation.

14. The diazotype material of claim 6 wherein the alkali metal cation is a sodium cation.

* * * * *

UNITED STATES PATENT AND TRADEMARK OFFICE

CERTIFICATE OF CORRECTION

PATENT NO. : 4,584,256

DATED : April 22, 1986

INVENTOR(S) : CLAUDE CEINTREY, ET AL.

It is certified that error appears in the above-identified patent and that said Letters Patent is hereby corrected as shown below:

ON THE TITLE PAGE after "[21] Appl. No.: 674,347"
insert --Filed: November 21, 1984--.

Signed and Sealed this

*Second* Day of *September 1986*

[SEAL]

*Attest:*

DONALD J. QUIGG

*Attesting Officer*

*Commissioner of Patents and Trademarks*